US008276645B2

(12) United States Patent
Rundquist et al.

(10) Patent No.: US 8,276,645 B2
(45) Date of Patent: Oct. 2, 2012

(54) POROSITY DETECTION

(75) Inventors: Victor F. Rundquist, Carrollton, GA (US); Ralph B. Dinwiddie, Jr., Knoxville, TN (US)

(73) Assignee: Southwire Company, Carrollton, GA (US)

( * ) Notice: Subject to any disclaimer, the term of this patent is extended or adjusted under 35 U.S.C. 154(b) by 648 days.

(21) Appl. No.: 12/405,288

(22) Filed: Mar. 17, 2009

(65) Prior Publication Data

US 2009/0229779 A1 Sep. 17, 2009

Related U.S. Application Data

(60) Provisional application No. 61/037,077, filed on Mar. 17, 2008, provisional application No. 61/148,503, filed on Jan. 30, 2009.

(51) Int. Cl.
*B22D 2/00* (2006.01)
*B22D 46/00* (2006.01)

(52) U.S. Cl. ..... 164/150.1; 164/151.4

(58) Field of Classification Search ..... 700/146; 164/4.1, 151.4, 150.1; 703/2
See application file for complete search history.

(56) References Cited

U.S. PATENT DOCUMENTS

| | | | | |
|---|---|---|---|---|
| 5,144,838 | A * | 9/1992 | Tsuboi | 73/579 |
| 5,179,860 | A * | 1/1993 | Tsuboi | 73/579 |
| 5,654,977 | A * | 8/1997 | Morris | 374/4 |
| 6,013,915 | A * | 1/2000 | Watkins | 250/341.1 |
| 6,097,019 | A * | 8/2000 | Lewis et al. | 219/750 |
| 6,150,645 | A * | 11/2000 | Lewis et al. | 219/715 |
| 6,394,646 | B1 * | 5/2002 | Ringermacher et al. | 374/7 |
| 6,690,016 | B1 * | 2/2004 | Watkins et al. | 250/341.7 |
| 7,045,029 | B2 * | 5/2006 | DeLucia et al. | 156/85 |
| 7,118,639 | B2 * | 10/2006 | DeLucia et al. | 156/85 |
| 7,159,641 | B2 * | 1/2007 | Yamamura et al. | 164/428 |
| 7,167,773 | B2 * | 1/2007 | Schneider et al. | 700/198 |
| 7,567,740 | B2 * | 7/2009 | Bayindir et al. | 385/101 |
| 7,617,863 | B2 * | 11/2009 | Yu et al. | 164/452 |
| 7,886,807 | B2 * | 2/2011 | Kirkman | 164/458 |
| 2005/0173820 | A1 * | 8/2005 | Schneider et al. | 264/40.1 |
| 2008/0035298 | A1 * | 2/2008 | Yu et al. | 164/455 |
| 2008/0083478 | A1 * | 4/2008 | Yamada et al. | 148/549 |

FOREIGN PATENT DOCUMENTS

| | | | |
|---|---|---|---|
| CN | 1341908 | A | 3/2002 |
| EP | 1 717 754 | A2 | 11/2006 |
| JP | 2011-514261 | | 5/2011 |

OTHER PUBLICATIONS

International Search Report dated Jul. 14, 2009 cited in Application No. PCT/US2009/037344.

(Continued)

*Primary Examiner* — Charles Kasenge
(74) *Attorney, Agent, or Firm* — Merchant & Gould

(57) ABSTRACT

A computer executing a software algorithm may be used to detect a depression in a temperature profile. The temperature profile may be smoothed to eliminate noise. Next, the temperature profile's center may be extracted. A polynomial may be fitted to extracted data. An algorithm used to fit the polynomial may guarantee that the fitted curve's peak may be below the actual temperature data's peak. Next, residuals may be calculated by subtracting the fitted curve from the actual data. If there is a dip at the center, then the residuals in the center may be less than zero. The software algorithm executing on the computer may then make a decision based on a sign of the residuals. For example, residuals less than zero may indicate bar porosity. Residuals above zero may indicate no porosity. The magnitude of the residuals may then be used to classify a size of a detected defect.

64 Claims, 5 Drawing Sheets

OTHER PUBLICATIONS

Chia et al., "The Metallurgy of Southwire's Continuous Rod," Journal of Metals, vol. 33, No. 2, Feb. 1981, pp. 68-74.
Ronald D. Adams, Southwire Company Metallurgical Laboratory, MP-4072, An Investigation of Copper Cast Bar Scale Formation Rate, pp. 1-11.
Ronald D. Adams, Southwire Metallurgical Laboratory, MP-3760, Examination of Gross Centerline Porosity in 5 Sq. In. Copper Bar, pp. 1-6.
Kiran Manchiraju et al., "Southwire Continuous Casting Technology and Introduction to Bar Porosity Detection Infrared System," (Proprietary and Confidential property of Southwire Company), Jan. 27, 2009, pp. 1-18.
Albert J. Phillips, "The Separation of Gases from Molten Metals," Institute of Metals, , pp. 20-49.
Chinese First Office Action dated Jul. 17, 2012 cited in Application No. 200980116712.7, 10 pgs.

* cited by examiner

POROSITY DETECTION

RELATED APPLICATION

Under provisions of 35 U.S.C. §119(e), Applicants claim the benefit of U.S. provisional application No. 61/037,077, filed Mar. 17, 2008, and U.S. provisional application No. 61/148,503, filed Jan. 30, 2009, both of which are incorporated herein by reference.

COPYRIGHTS

All rights, including copyrights, in the material included herein are vested in and the property of the Applicants. The Applicants retain and reserves all rights in the material included herein, and grants permission to reproduce the material only in connection with reproduction of the granted patent and for no other purpose.

BACKGROUND

When continuously casting metal products, it is important to get the chemistry and environmental conditions correct before molten metal associated with the continuously casting process solidifies. During solidification, if the metal's chemistry or cooling is incorrect, voids may be formed in the casting process' product. These voids may be detrimental to the product. For example, in a rod making process, a final product may be wire. This wire may break if there are voids in the original casting associated with the rod. Structural products, like tubes and billets, may have their mechanical properties adversely affected by voids in the original casting.

SUMMARY

This Summary is provided to introduce a selection of concepts in a simplified form that are further described below in the Detailed Description. This Summary is not intended to identify key features or essential features of the claimed subject matter. Nor is this Summary intended to be used to limit the claimed subject matter's scope.

Porosity detection may be provided. First a natural temperature profile may be created for a casting from a first edge to a second edge. Next, a polynomial may be fitted to the natural temperature profile. Then the natural temperature profile may be compared to the fitted polynomial. It may then be indicated that a void exists in the casting when, in response to the comparison, a peak value of the natural temperature profile is less than a peak value of the polynomial.

Both the foregoing general description and the following detailed description provide examples and are explanatory only. Accordingly, the foregoing general description and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1:
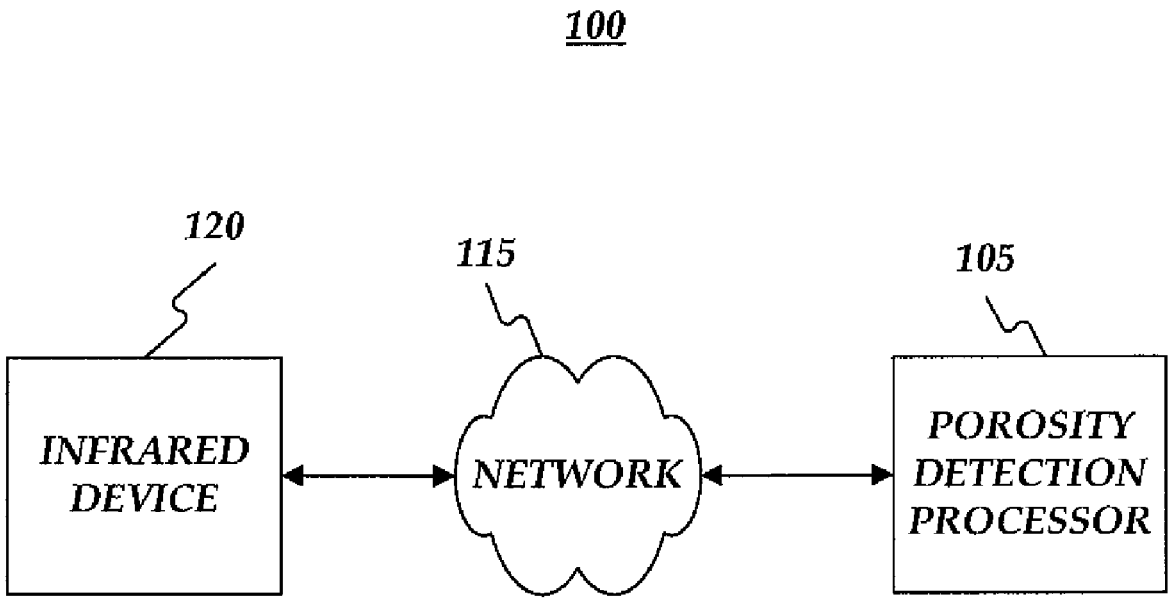
FIG. 1 shows a porosity detection system.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

Infrared thermography may be used for detecting flaws, for example, in steel billet castings. This may be done in a static environment and used to detect surface flaws. Embodiments of the invention may apply a thermographic technique. Consistent with embodiments of the inventions, three problems may be solved: i) knowing when a casting has internal flaws; ii) allows for another optimization parameter in a continuous casting process; and iii) helping to determine if problems occur in a casting process.

When it is know that a casting has internal flaws, the casting's end product can be classified appropriately. This may save significantly on shipping costs associated with transporting bad product to and from a customer. By monitoring for flaws in real-time, a plant operator can speed up a casting process until just before flaws are being detected. This may allow a plant's production speed to be optimized for current conditions. When problems with a metal's chemistry or in a casting's cooling are introduced, these problems may manifest as voids in the casting. By detecting these voids in real-time, the plant operator may be alerted to problems with a casting process before too much product is produced and ultimately wasted as scrap.

When continuously casting metal products, it is desirable to get the chemistry and environmental conditions correct before molten metal associated with the continuously casting process solidifies. During solidification, if the metal's chemistry or cooling is incorrect, voids may be formed in the casting process' product. These voids may be detrimental to the product. For example, in a rod making process, a final product may be a wire. This wire may break if there are voids in the original casting associated with the rod. Structural products, like tubes and billets, may have their mechanical properties adversely affected by voids in the original casting. Therefore, consistent with embodiments of the invention, monitoring a casting in real-time for internal flaws may be provided.

Using x-ray or electron beam diffraction principles may introduce high implementation costs and may create undesirable environmental conditions for workers exposed to a process using such principles. By using infrared thermography, embodiments of the present invention may detect voids internal to a casting by cooling a casting's surface and allowing a void's heat signature to propagate to the casting's surface.

Embodiments consistent with the invention may comprise a system for providing porosity detection. The system may comprise a memory storage for maintaining a database and a processing unit coupled to the memory storage. The processing unit may be operative to create a natural temperature profile for a casting from a first edge to a second edge. Moreover, the processing unit may be operative to fit a second order polynomial to the natural temperature profile. The processing unit may then compare the natural temperature profile to the fitted second order polynomial. Furthermore, the processing unit may be operative to indicate that a void exists in the casting when, in response to the comparison, a peak of the natural temperature profile peak is below a peak of the second order polynomial.

FIG. 1 shows a porosity detection system 100 including, for example, a porosity detection processor 105, a network 115, and an infrared device 120. Infrared device 120 may comprise, but is not limited to, an infrared camera or an infrared detector. Consistent with embodiments of the present invention, the aforementioned memories, processing units, and other components may be implemented in a system, such as porosity detection system 100 of FIG. 1. Any suitable combination of hardware, software, and/or firmware may be used to implement the memories, processing units, or other components. By way of example, the memories, processing units, or other components may be implemented with porosity detection processor 105 in combination with system 100. The aforementioned system and processor are examples and other systems and processors may comprise the aforementioned memories, processing units, or other components, consistent with embodiments of the present invention.

Figure 2:
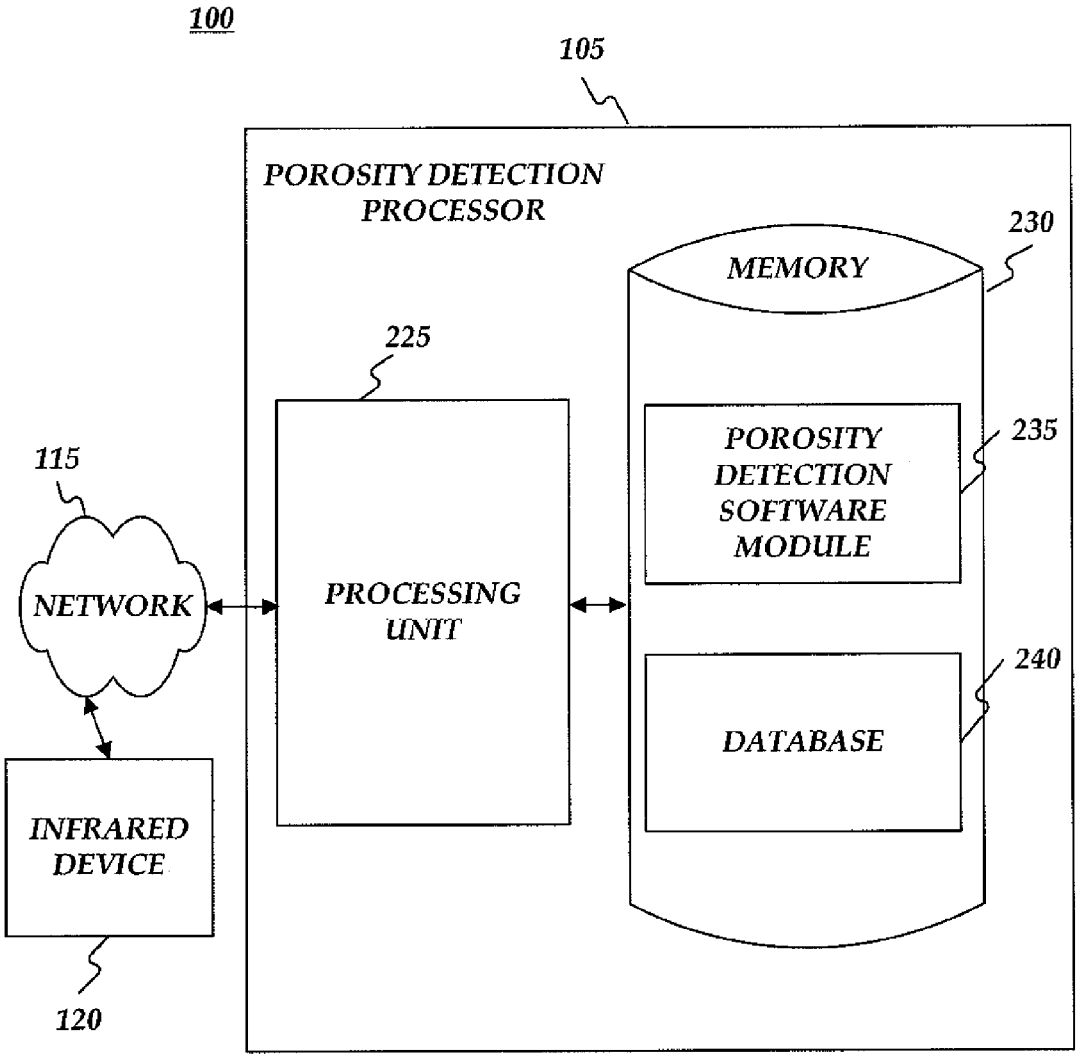
FIG. 2 shows the porosity detection system of FIG. 1 in more detail.

FIG. 2 shows porosity detection processor 105 of FIG. 1 in more detail. As shown in FIG. 2, porosity detection processor 105 may include a processing unit 225 and a memory 230. Memory 230 may include a porosity detection software module 235 and a database 240. While executing on processing unit 225, porosity detection software module 235 may perform processes for providing porosity detection, including, for example, one or more method 300 stages described below with respect to FIG. 3.

Porosity detection processor 105 ("the processor") included in system 100 may be implemented using a personal computer, network computer, mainframe, or other similar microcomputer-based workstation. The processor may though comprise any type of computer operating environment, such as hand-held devices, multiprocessor systems, microprocessor-based or programmable sender electronic devices, minicomputers, mainframe computers, and the like. The processor may also be practiced in distributed computing environments where tasks are performed by remote processing devices. Furthermore, the processor may comprise a mobile terminal, such as a smart phone, a cellular telephone, a cellular telephone utilizing wireless application protocol (WAP), personal digital assistant (PDA), intelligent pager, portable computer, a hand held computer, a conventional telephone, or a facsimile machine. The aforementioned systems and devices are exemplary and the processor may comprise other systems or devices.

Network 115 may comprise, for example, a local area network (LAN) or a wide area network (WAN). When a LAN is used as network 115, a network interface located at any of the processors may be used to interconnect any of the processors. When network 115 is implemented in a WAN networking environment, such as the Internet, the processors may typically include an internal or external modem (not shown) or other means for establishing communications over the WAN. Further, in utilizing network 115, data sent over network 115 may be encrypted to insure data security by using known encryption/decryption techniques.

In addition to utilizing a wire line communications system as network 115, a wireless communications system, or a combination of wire line and wireless may be utilized as network 115 in order to, for example, exchange web pages via the Internet, exchange e-mails via the Internet, or for utilizing other communications channels. Wireless can be defined as radio transmission via the airwaves. However, it may be appreciated that various other communication techniques can be used to provide wireless transmission, including infrared line of sight, cellular, microwave, satellite, packet radio, and spread spectrum radio. The processors in the wireless environment can be any mobile terminal, such as the mobile terminals described above. Wireless data may include, but is not limited to, paging, text messaging, e-mail, Internet access and other specialized data applications specifically excluding or including voice transmission. For example, the processors may communicate across a wireless interface such as, for example, a cellular interface (e.g., general packet radio system (GPRS), enhanced data rates for global evolution (EDGE), global system for mobile communications (GSM)), a wireless local area network interface (e.g., WLAN, IEEE 802, WiFi, WiMax), a bluetooth interface, another RF communication interface, and/or an optical interface.

Infrared device 120 may comprise a thermographic camera, comprising a forward looking infrared camera, scanning infrared camera, or infrared detector. Infrared device 120 may connect to porosity detection processor 105 over network 115. Infrared device 120 may form an image using infrared radiation, similar to a common camera that forms an image using visible light. Instead of the 450-750 nanometer range of the visible light camera, infrared device 120 may operate in wavelengths as long as 14,000 nm (i.e. 14 μm).

System 100 may also transmit data by methods and processes other than, or in combination with, network 115. These methods and processes may include, but are not limited to, transferring data via, diskette, flash memory sticks, CD ROM, facsimile, conventional mail, an interactive voice response system (IVR), or via voice over a publicly switched telephone network.

Figure 3:
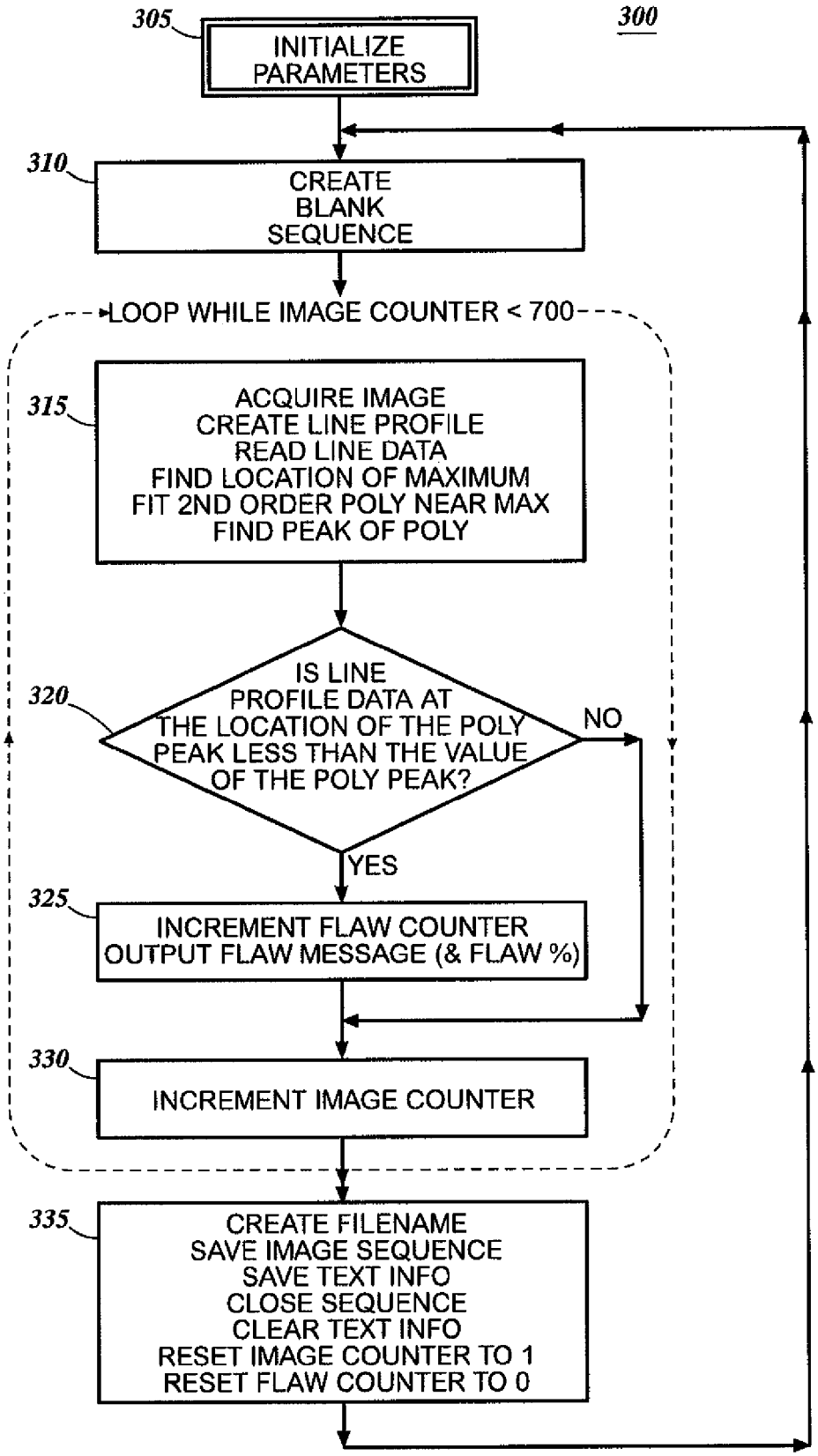
FIG. 3 is a flow chart of a method for providing porosity detection.

FIG. 3 is a flow chart setting forth general stages involved in a method 300 consistent with embodiments of the invention for providing porosity detection. Method 300 may be implemented using porosity detection processor 105 as described in more detail above with respect to FIG. 2. Ways to implement the stages of method 300 will be described in greater detail below. Method 300 may be implemented using an infrared device (e.g. infrared device 120) coupled to a computer (e.g. porosity detection processor 105) running an image analysis software (e.g. porosity detection software module 235.) As described below, the image analysis software may decode an image and look for flaws.

As shown in FIG. 3, parameters may be initialized (stage 305) and a blank sequence may be created (stage 310.) Porosity detection processor 105 may then look at a casting's infrared image as the casting moves across infrared device 120's field of view. (Stage 315.) As the casting is moving, porosity detection processor 105 may look for flaws. For example, porosity detection processor 105 may first take an average across a predetermined length of the casting. (Stage 315.) A temperature at the casting's edges may be cooler than the casting's middle because there may be more energy in the casting's center than at the edges. A plot comprising a natural temperature profile for the casting from edge to edge may yield a parabola or a Gaussian style curve comprising a averaged temperature profile.

Next, porosity detection processor 105 may find the averaged temperature profile's maximum value. (Stage 315.) The maximum value may comprise the casting's center. A second order polynomial may then be fitted to the profile. (Stage 315.) The second order polynomial's peak may be just below the data's peak. Porosity detection processor 105 may next look at the data's peak as it relates to the created second order polynomial. (Stage 320.) If the data in the region of the second order polynomial's peak is lower than the second order polynomial's peak, then porosity detection processor 105 may indicate that a void has been found in the casting as illustrated and described in more detail below with respect to FIG. 4B. (Stage 325.) This may be because a void in the casting may have less energy than the surrounding material and the temperature at the surface may be less than it would be if there were no void.

Figure 4A:
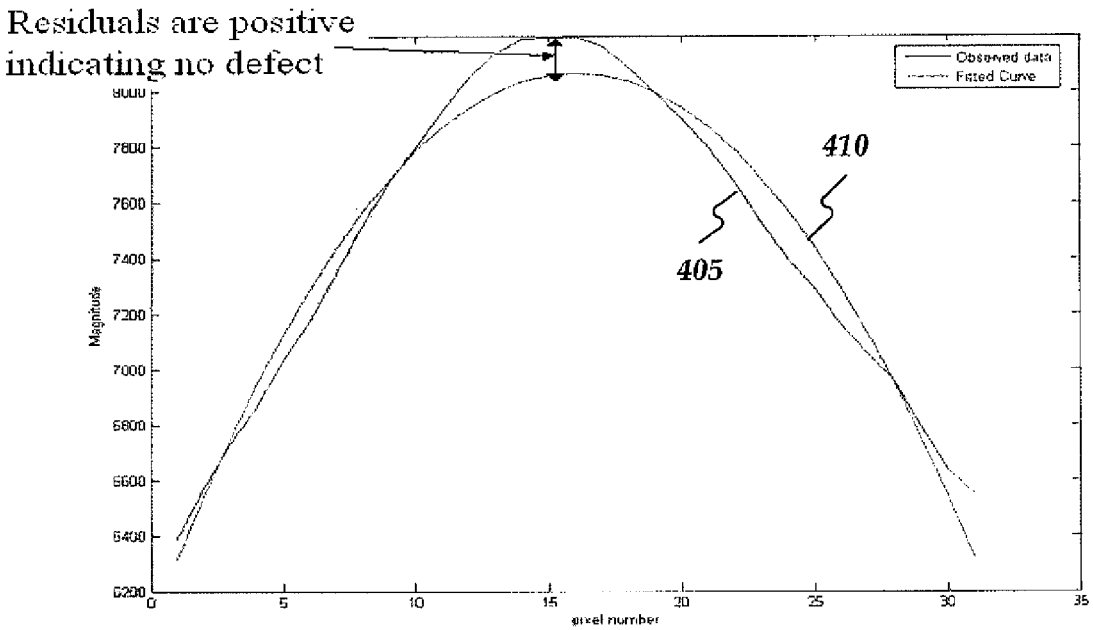
FIG. 4A is a sample void-less section temperature profile.

FIG. 4A is a sample void-less section temperature profile. As shown in FIG. 4A, a curve 405 may correspond to a natural temperature profile for a casting. A curve 410 may correspond to a polynomial fitted to the natural temperature profile of curve 405. Because a peak value of curve 405 is greater than a peak value of curve 410, this may indicate no void is present in the casting.

Figure 4B:
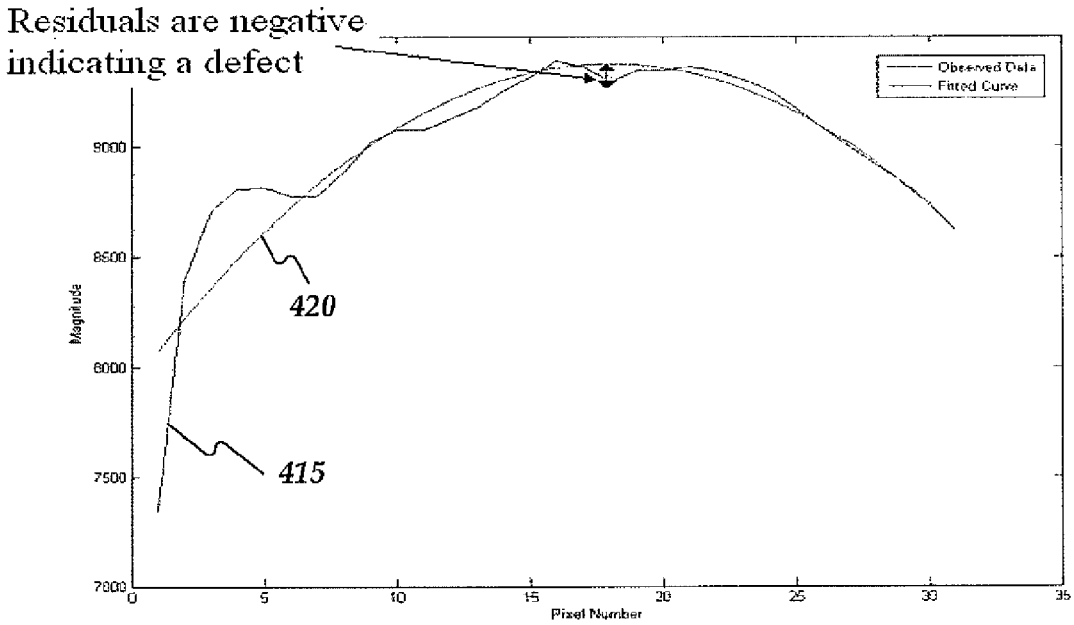
FIG. 4B is a temperature profile corresponding to a casting including a void.
Figure 5:
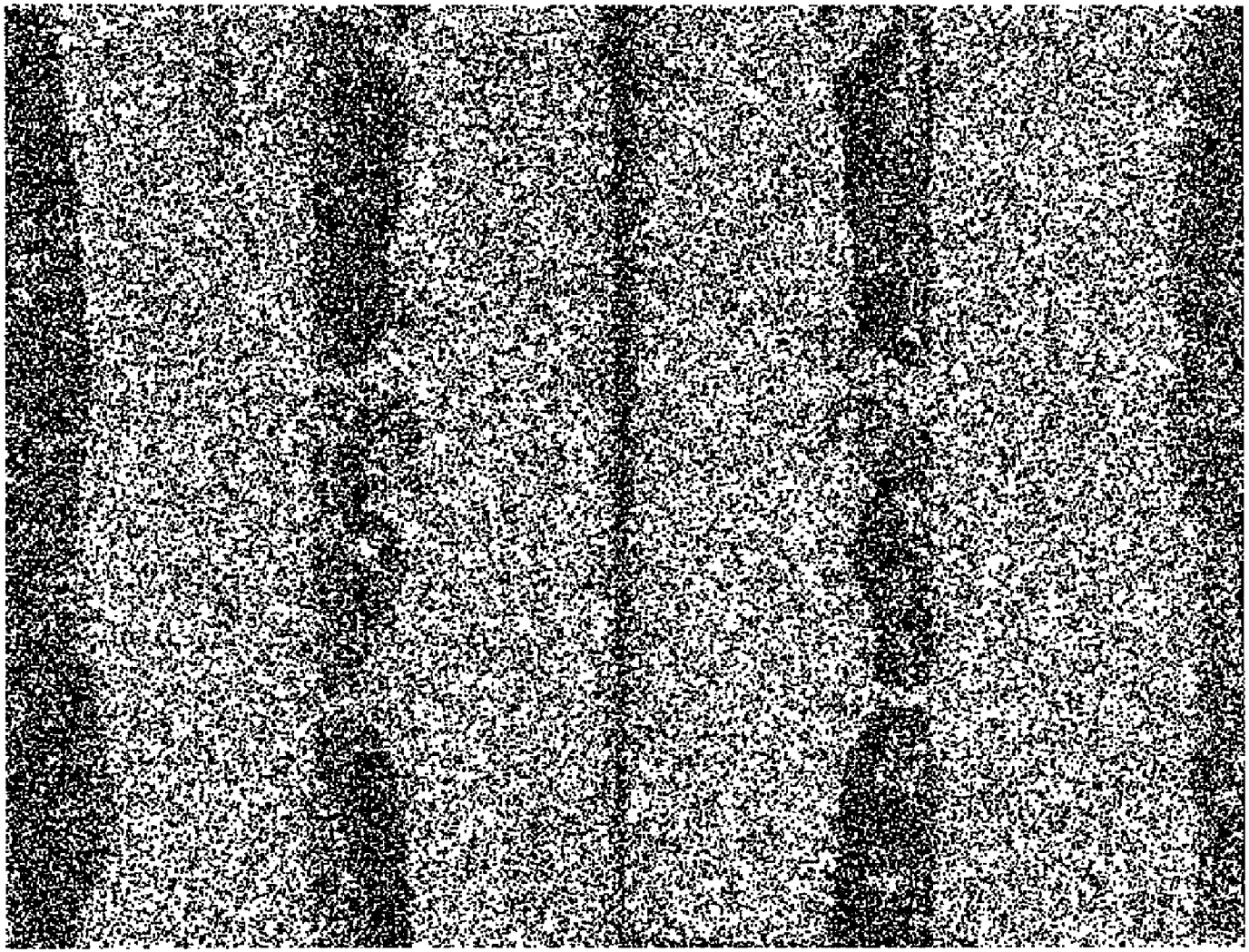
FIG. 5 illustrates a void in a casting.

FIG. 4B is a temperature profile corresponding to a casting including a void. As shown in FIG. 4B, a curve 415 may correspond to a natural temperature profile for a casting. A curve 420 may correspond to a polynomial fitted to the natural temperature profile of curve 415. Because a peak value of curve 415 is less than a peak value of curve 420, this may indicate that a void is present in the casting. FIG. 5 is a photograph showing a void in a casting detected by embodiments of the invention.

After the current image is analyzed by porosity detection processor 105, a next image may be cued and the aforementioned process may be repeated. (Stage 330.) A counter may be maintained to count the number of flaws present in the casting. (Stage 325.) The resulting data and image frames may be saved for further processing if needed. (Stage 335.)

The following is a code listing for a software example that may be used in conjunction with embodiments of the present invention for porosity detection software module 235. The following is an example, and other software modules may be used.

```
Option Explicit
Sub Southwire( )
Dim LineProfID As Integer
Dim PeakVal As Single
Dim PeakLocation As Integer
Dim a0 As Single
Dim a1 As Single
Dim a2 As Single
Dim t0 As Double
Dim t1 As Double
Dim t2 As Double
Dim i As Integer
Dim j As Integer
Dim k As Integer
Dim x As Integer
'Dim ProfDat(321) As Single 'Allocate array for the data
Dim LineDat(30) As Single 'Allocate array for the data
Dim Ndata As Integer 'Number of frames in sequence
Dim LastDirectory As String*255
Dim S As String*1
Dim Iname As String*255
Dim Title As String*60
Dim Flaw As String*30
Dim OldX1 As Integer
Dim OldY1 As Integer
Dim OldX2 As Integer
Dim OldY2 As Integer
Dim X1 As Integer
Dim Y1 As Integer
```

-continued

```
Dim X2 As Integer
Dim Y2 As Integer
Dim numbins As Integer
Dim endPts(2) As POINTAPI
Dim stats(10) As Single
Dim S0S1 As Double
Dim S0S2 As Double
Dim S0S3 As Double
Dim S0S4 As Double
Dim S1S1 As Double
Dim S1S2 As Double
Dim S1S3 As Double
Dim S1S4 As Double
Dim S2S2 As Double
Dim S2S3 As Double
Dim S2S4 As Double
Dim S3S2 As Double
Dim S3S3 As Double
Dim DetS As Double
Dim Fit8 As Single
Dim PeakIndex As Integer
Dim TotalFlaws As Integer
Dim Skipped As Integer
Dim PercentFlaws As Single
Dim NoiseLevelPercent As Single
' Initiallization
S0S1 = 2312
S0S2 = 25432
S0S3 = 314432
S0S4 = 4145416
S1S1 = 18496
S1S2 = 203456
S1S3 = 2515456
S1S4 = 33163328
S2S2 = 2238016
S2S3 = 27670016
S2S4 = 364796608
S3S3 = 342102016
DetS = 53767872
TotalFlaws = 0
NoiseLevelPercent = 0.009 ' 0.01 = 1% noise, 0.05= 5% noise, etc.
'************************************* Read Last Used Values for
'************************************* x1, y1, x2, y2
Open "C:\IPWin4\SouthwireTemp.txt" For Input As #1
Input #1, LastDirectory, OldX1, OldY1, OldX2, OldY2
Close #1
'LastDirectory= "C:\IPWIN4\Images\Feb 8\"
'OldX1 = 60
'OldY1 = 60
'OldX2 = 80
'OldY2 = 239
ret = IpOutputClear( )
ret = IpOutputShow(1)
ret = IpStGetName("Select Sequence",LastDirectory,"*.FTS",Iname)
If ret = 0 Then GoTo StopEarly
ret = IpWsLoad(Iname, "FTS")
ret = IpDrShow(1)
ret = IpDrSet(DR_BEST, 0, IPNULL)
ret = IpSeqSet(SEQ_ACTIVEFRAME, 0)
i=255
While S <> "\"
i=i-1
s = Mid$(Iname, i, 1)
'If s<>"" Then ret = IpOutput("i = " + Str$(i) + " S = " + S$+
Chr$(13) + Chr$(10))
Wend
LastDirectory = Left$(Iname, i)
'ShortLastDirectory = Left(Iname, i-1)
x=255
While S <> "."
x = x - 1
If X<1 Then
IpOutput("x = " + Str$(x) + " i = " + Str(i) + Chr$(13) +
Chr$(10))
GoTo StopEarly
End If
S = Mid$(Iname, x, 1)
Wend
'ret = IpOutput("x = " + Str$(x) + " i = " + Str(i) + Chr$(13) +
```

-continued

```
Chr$(10))
x = x − i − 1
Title = Mid$(Iname, i+1, x)
ret = IpSeqGet(SEQ_NUMFRAMES, Ndata)
LineProfID = IpProfCreate( )
ret = IpProfSetAttr(LINETYPE, THICKVERT)
ret = IpProfLineMove(OldX1, OldY1, OldX2, OldY2)
If MsgBox("Please adjust the position of the line. Then press
OK",vbOkCancel) = vbCancel Then End
ret = IpProfGet(GETPOINTS, 0, endPts(0))
Open "C:\IPWin4\SouthwireTemp.txt" For Output As #1
Write#1, LastDirectory, endPts(0).x, endPts(0).y, endPts(1).x, endPts(1).y
Close#1
ret = IpOutput(Trim$(Title) + Chr$(13) + Chr$(10))
ret = IpOutput(Chr$(13) + Chr$(10))
ret = IpOutput("Coordinates: x1= "+ Trim(Str(endPts(0).x))+" y1=
"+Trim(Str(endPts(0).y))+" x2= "+Trim(Str(endPts(1).x))+" y2=
"+Trim(Str(endPts(1).y)) + Chr$(13) + Chr$(10))
ret = IpOutput("Image# Flaw?" + Chr$(13) + Chr$(10))
numbins = endPts(1).y−endPts(0).y + 1
ReDim profdat(numbins) As Single
'ret = IpOutput("Numbibs="+Str(numbins) + Chr$(13) + Chr$(10))
'*********************************************
'*
'* Read Data and Re-index
'*
'*********************************************
For i=0 To Ndata−1
ret = IpProfGet(GETVALUES, numbins, profdat(0))
ret = IpProfGet(GETSTATS, 0, stats(0))
PeakVal = stats(4)
PeakLocation =0
j=0
Do
j=j+1
If profdat(j)>14000 Then
Flaw="Skipped Due to Noise"
Skipped = Skipped + 1
GoTo SkipFrame
End If
If profdat(j)=PeakVal Then PeakLocation = j
Loop While PeakLocation = 0
For j=0 To 16
k=PeakLocation−8+j
LineDat(j) = ProfDat(k)
'ipoutput(Trim(Str(LineDat(j)))+ Chr$(13)+Chr$(10))
Next j
'*********************************************
'*
'* Second Order Polynomial Fit Routine
'*
'*********************************************
T0=0
T1=0
T2=0
For k=0 To 16
T0=T0+LineDat(k)
T1=T1+LineDat(k)*k
T2=T2+LineDat(k)*k^2
Next k
a0=(t0*S2S4+t2*s1s3+t1*s2s3−s2s2*t2−s1s4*t1−s3s3*t0)/DetS
a1=(t1*s0s4+t0*s2s3+t2*s1s2−t1*s2s2−t2*s0s3−t0*s1s4)/DetS
a2=(t2*s0s2+t1*s1s2+t0*s1s3−t0*s2s2−t1*s0s3−t2*s1s1)/DetS
PeakIndex = Int(−a1/(2*a2))
If ((PeakIndex<0) Or (PeakIndex>17)) Then
Flaw="Skipped Due to Bad Fit"
Skipped = Skipped + 1
GoTo SkipFrame
End If
'ret = IpOutput(Trim(Str(PeakIndex))+" " + Chr$(13) + Chr$(10))
Fit8=a0+a1*PeakIndex+a2*PeakIndex^2
If (LineDat(PeakIndex)−((1−NoiseLevelPercent)*Fit8))<0 Then
Flaw="YES"
TotalFlaws=TotalFlaws+1
Else
Flaw="NO"
End If
Skip Frame:
ret = IpOutput(Trim(Str(i))+" " + Flaw + Chr$(13) + Chr$(10))
'ret = IpOutput("PeakIndex = "+Trim(Str(PeakIndex))+" " + Flaw +
```

-continued

```
Chr$(13) + Chr$(10))
'ret = IpOutput("LineDat-F8 = "+Trim(Str(LineDat(PeakIndex)−Fit8))+
Chr$(13) + Chr$(10))
'ret = IpOutput("="+Trim(Str(a0))+"+"+Trim(Str(a1))+
"*x+"+Trim(Str(a2))+"*x^2"+ Chr$(13) + Chr$(10))
'ret = IpOutput(Chr$(13) + Chr$(10))
ret = IpSeqPlay(SEQ_NEXT)
Next i
ret = IpOutput("RESULTS: "+Trim(Str(TotalFlaws))+" Flaws out of" +
Trim(Str(NData-Skipped))+" images" + Chr$(13) + Chr$(10))
PercentFlaws = Int(((Total Flaws*100)/(NData-Skipped))*100)/100
ret = IpOutput("Percent of Images with
Flaws = "+Trim(Str(PercentFlaws))+"
%")
StopEarly:
End Sub
```

Consistent with embodiments of the invention, a computer executing a software algorithm may be used to detect a depression in a temperature profile. First, the temperature profile may be smoothed slightly to eliminate systematic noise. Next, the center of the temperature profile may be extracted. A polynomial (e.g. an nth order polynomial) may be fitted to extracted data. An algorithm used to fit the polynomial may guarantee that the peak of the fitted curve may be below the peak of the actual data. Next, residuals may be calculated by subtracting the fitted curve from the actual data. If there is a dip at the center, then the residuals in the center may be less than zero. The software algorithm executing on the computer may then make a decision based on a sign of the residuals. For example, residuals less than zero may indicate bar porosity. Residuals above zero may indicate no porosity. The magnitude of the residuals may then be used to classify a size of a detected defect.

OPERATIONAL EXAMPLE

Table 1 summarizes data that was obtained using a process consistent with embodiments of the invention. Table 1 shows that, at 45 feet per minute (FPM), test 1 measured 4.5% flaws using a micrometer after bars were cooled and cut open. Consistent with embodiments of the invention, the IR process measured 5.6% flaws. The difference of 1.1% may be attributed to noise in the process and IR method. 45 FPM test 2 shows a difference of 0.5% between the IR and measured flaws. When the casting rate was increased to the 50 and 52 FPM, the IR and measured flaws increased dramatically. The negative difference for the 50 FPM may be attributed to an error in the frame rate of the camera over counting flaws. These errors needed to be corrected and a system designed for permanent installation on the casting machine

TABLE 1

Correlation data for selected production rates

| Bar Speed[1] | Measured Flaws[2] | Flaws detected by IR Imaging[3] | Difference[4] |
|---|---|---|---|
| 45 Test 1 | 4.5% | 5.6% | 1.1 |
| 45 Test 2 | 4.5% | 5.0% | 0.5 |
| 50 | 17.2% | 15.3% | −1.9 |
| 52 | 15.2% | 14.8% | 0.4 |

[1]Speed of casting machine in ft/min
[2]Flaws as measured in the bar with a micrometer
[3]Output of the IR flaw detection system
[4]Difference = IR − Measured Table 2 shows the effect of different noise figures on the difference between the IR measured flaws consistent with embodiments of the invention and the actual flaws as a function of the flaw size. Independent of the casting rate, a noise factor of 0.012 may be used to look for flaws above 0.003 $in^2$, 0.0095 to look for flaws above 0.0019 $in^2$, and 0.0078 to look for flaws above 0.0007 $in^2$.

TABLE 2

| Noise corrected data % Difference for different speeds and flaw sizes | | | |
|---|---|---|---|
| Flaw Size ($in^2$) | Large 0.003 | Medium 0.0019 | Small 0.0007 |
| Noise Factor | .012 | .0095 | .0078 |
| 45 FPM[1] | −0.2 | −1.2 | −1.0 |
| 50 FPM | −0.4 | −1.8 | −4.9 |
| 52 FPM | 0.0 | 3.4 | 5.6 |

[1]Feet per minute

Consistent with embodiments of the invention, the size of detected flaws may be classified. The flaws may be grouped, for example, into three size groups; small, medium, and large. The actual size of flaws that correspond to respective size groups may be dependent on, for example, an individual rod mill. To classify a flaw, the magnitude of a residual that indicated the flaw may be analyzed and used as the classification criteria. Table 3 summarizes data that may be used to define, for example, the small, medium, and large flaw size groups. At 47, 50, and 52 FPM, the total flaws counted may be broken up into the three size categories. Next the residual magnitudes may be split, for example, into the following:

Below 80=Small

Above 80 and below 140=Medium

Above 140=Large

These criteria may be used to calculate a percentage of the total flaws that each size category may have contributed. In Table 3, at 44 FPM, 0.6% of the production had flaws, and of that 0.6%, 100% were small flaws. At 47 FPM, 5.6% of production had flaws, and of that 5.6%, 86% were small, 13% were medium, and 1% was large. The flaws at 52 FPM increased to 7%, of which, 73% were small, 23% were medium, and 4% were large. "Percent production with flaws" may be defined as the percentage of inches, centimeters, etc. in a production that a flaw may have been detected. For example if the value is 10%, then when 100 inches of sample bar is analyzed, 10 inches of the sample may contain flaws. This may not indicate, however, that there are 10 inches of flaw area in the sample.

TABLE 3

| Flaw Size Distribution | | | | | | | | |
|---|---|---|---|---|---|---|---|---|
| Speed | Avg Flaw Size | Max Flaw Size | Flaw per Inch | % Prod with Flaws | Avg Residue | % small | % medium | % large |
| 44 FPM | 0.0026 | 0.019 | 0.14 | 0.6 | 80 | 100 | 0 | 0 |
| 47 FPM | 0.008 | 0.216 | 0.18 | 5.6 | 100 | 86 | 13 | 1 |
| 52 FPM | 0.006 | 0.240 | 0.54 | 7 | 140 | 73 | 23 | 4 |

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the invention, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present invention may be embodied in hardware and/or in software (including firmware, resident software, micro-code, etc.). In other words, embodiments of the present invention may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, a carrier wave from the Internet, or other forms of RAM or ROM. Further, the disclosed methods' stages may be modified in any manner, including by reordering stages and/or inserting or deleting stages, without departing from the invention.

While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

What is claimed is:

1. A system for providing porosity detection, the system comprising:

a memory storage; and a processing unit coupled to the memory storage, wherein the processing unit is operative to:

create a natural temperature profile for a casting;

fit a polynomial to the natural temperature profile;

compare the natural temperature profile to the fitted polynomial; and indicate that a void exists in the casting when, in response to the comparison, a peak value of the natural temperature profile is less than a peak value of the polynomial.

2. The system of claim 1, wherein the casting comprises one of the following: a copper casting and an aluminum casting.

3. The system of claim 1, wherein the processing unit being operative to create the natural temperature profile for the casting comprises the processing unit being operative to create the natural temperature profile for the casting from a first edge of the casting to a second edge of the casting.

4. The system of claim 1, further comprising the processing unit being operative to receive, from an infrared device, data corresponding to a natural temperature for the casting.

5. The system of claim 1, further comprising the processing unit being operative to indicate that a void does not exist in the casting when, in response to the comparison, the peak value of the natural temperature profile is one of the following: greater than the peak value of the polynomial and equal to the peak value of the polynomial.

6. The system of claim 5, further comprising the processing unit being operative to, in response to the indication that the void does not exist in the casting, speed up a casting process associated with the casting.

7. The system of claim 1, further comprising the processing unit being operative to, in response to the indication that the void exists in the casting, slow down a casting process associated with the casting.

8. The system of claim 1, wherein fitting the polynomial to the natural temperature profile comprises fitting the polynomial comprising a second order polynomial.

9. A method for providing porosity detection, the method comprising:

creating, by a computer, a natural temperature profile for a casting;

fitting a second order polynomial to the natural temperature profile;

comparing the natural temperature profile to the fitted second order polynomial; and indicating that a void exists in the casting when, in response to the comparison, a peak value of the natural temperature profile is less than a peak value of the second order polynomial.

10. The method of claim 9, wherein creating the natural temperature profile for the casting comprises creating the natural temperature profile for the casting comprising one of the following: a copper casting and an aluminum casting.

11. The method of claim 9, wherein the creating the natural temperature profile for the casting comprises creating the natural temperature profile for the casting from a first edge of the casting to a second edge of the casting.

12. The method of claim 9, further comprising receiving, from an infrared device, data corresponding to a natural temperature for the casting.

13. The method of claim 9, further comprising indicating that a void does not exist in the casting when, in response to the comparison, the peak value of the natural temperature profile is one of the following: greater than the peak value of the second order polynomial and equal to the peak value of the second order polynomial.

14. The method of claim 13, further comprising, in response to the indication that the void does not exist in the casting, speeding up a casting process associated with the casting.

15. The method of claim 9, further comprising, in response to the indication that the void exists in the casting, slowing down a casting process associated with the casting.

16. A computer-readable storage medium device which stores a set of instructions which when executed performs a method for providing porosity detection, the method executed by the set of instructions comprising:

receiving, from an infrared device, data corresponding to a natural temperature for the casting;

creating, a natural temperature profile based on the data for a casting from a first edge of the casting to a second edge of the casting;

fitting a polynomial to the natural temperature profile;

comparing the natural temperature profile to the fitted polynomial;

indicating that a void exists in the casting when, in response to the comparison, a peak value of the natural temperature profile is less than a peak value of the polynomial; and indicating that a void does not exist in the casting when, in response to the comparison, the peak value of the natural temperature profile is one of the following: greater than the peak value of the polynomial and equal to the peak value of the polynomial.

17. The computer-readable medium of claim 16, further comprising, in response to the indication that the void does not exist in the casting, speeding up a casting process associated with the casting.

18. The computer-readable medium of claim 16, further comprising, in response to the indication that the void exists in the casting, slowing down a casting process associated with the casting.

19. The computer-readable medium of claim 16, wherein creating the natural temperature profile for the casting comprises creating the natural temperature profile for the casting comprising one of the following: a copper casting and an aluminum casting.

20. The computer-readable medium of claim 16, wherein fitting the polynomial to the natural temperature profile comprises fitting the polynomial comprising a second order polynomial.

21. A system for providing porosity detection, the system comprising:

a memory storage; and a processing unit coupled to the memory storage, wherein the processing unit is operative to:

create a heat signature profile for a casting;

fit a mathematical function to the heat signature profile;

compare the heat signature profile to the fitted mathematical function; and indicate that a void exists in the casting when, in response to the comparison, a peak value of the heat signature profile is less than a peak value of the mathematical function.

22. The system of claim 21, wherein the casting comprises one of the following: a copper casting and an aluminum casting.

23. The system of claim 21, wherein the processing unit being operative to create the heat signature profile for the casting comprises the processing unit being operative to create the heat signature profile for the casting from a first edge of the casting to a second edge of the casting.

24. The system of claim 21, further comprising the processing unit being operative to receive, from an infrared device, data corresponding to a heat signature for the casting.

25. The system of claim 21, further comprising the processing unit being operative to, in response to the indication that the void exists in the casting, slow down a casting process associated with the casting.

26. The system of claim 21, wherein the processing unit being operative to fit the mathematical function to the heat signature profile comprises the processing unit being operative to fit the mathematical function comprising a polynomial.

27. The system of claim 21, wherein the processing unit being operative to fit the mathematical function to the heat signature profile comprises the processing unit being operative to fit the mathematical function comprising a second order polynomial.

28. The system of claim 21, wherein the processing unit being operative to fit the mathematical function to the heat signature profile comprises the processing unit being operative to fit the mathematical function comprising a second order mathematical function.

29. The system of claim 21, wherein the processing unit being operative to create the heat signature profile for the casting comprises the processing unit being operative to create the heat signature profile comprising a natural temperature profile for the casting.

30. A method for providing porosity detection, the method comprising:

fitting, by a computer, a mathematical function to a radiation profile for a casting;

comparing the radiation profile to the fitted mathematical function; and indicating that a void exists in the casting when a peak value of the radiation profile is less than a peak value of the mathematical function.

31. The method of claim 30, further comprising creating the radiation profile for the casting.

32. The method of claim 31, wherein creating the radiation profile for the casting comprises creating the radiation profile for the casting from a first edge of the casting to a second edge of the casting.

33. The method of claim 30, further comprising receiving, from an infrared device, data corresponding to the radiation profile for the casting.

34. The method of claim 32, wherein receiving, from the infrared device, the data corresponding to the radiation profile for the casting comprises receiving, from the infrared device comprising an infrared camera.

35. The method of claim 30, further comprising indicating that a void does not exist in the casting when, in response to the comparison, the peak value of the radiation profile is one of the following: greater than the peak value of the mathematical function and equal to the peak value of the mathematical function.

36. The method of claim 35, further comprising, in response to the indication that the void does not exist in the casting, speeding up a casting process associated with the casting.

37. The method of claim 30, further comprising, in response to the indication that the void exists in the casting, slowing down a casting process associated with the casting.

38. The method of claim 30, wherein fitting the mathematical function to the radiation profile comprises fitting the mathematical function to the radiation profile comprising a heat signature profile for the casting.

39. The method of claim 38, wherein fitting the mathematical function to the radiation profile comprises fitting the mathematical function to the radiation profile comprising the heat signature profile comprising a natural temperature profile for the casting.

40. A system for providing porosity detection, the system comprising:

a memory storage; and a processing unit coupled to the memory storage, wherein the processing unit is operative to:

create a heat signature profile for a casting;

fit a mathematical function to the heat signature profile;

compare the heat signature profile to the fitted mathematical function; and indicate that a void does not exist in the casting when, in response to the comparison, a peak value of the heat signature profile is one of the following: greater than a peak value of the mathematical function and equal to a peak value of the mathematical function.

41. The system of claim 40, wherein the casting comprises one of the following: a copper casting and an aluminum casting.

42. The system of claim 40, wherein the processing unit being operative to create the heat signature profile for the casting comprises the processing unit being operative to create the heat signature profile for the casting from a first edge of the casting to a second edge of the casting.

43. The system of claim 40, further comprising the processing unit being operative to receive, from an infrared device, data corresponding to a heat signature for the casting.

44. The system of claim 40, further comprising the processing unit being operative to, in response to the indication that the void does not exist in the casting, speed up a casting process associated with the casting.

45. The system of claim 40, wherein the processing unit being operative to fit the mathematical function to the heat signature profile comprises the processing unit being operative to fit the mathematical function comprising a polynomial.

46. The system of claim 40, wherein the processing unit being operative to fit the mathematical function to the heat signature profile comprises the processing unit being operative to fit the mathematical function comprising a second order polynomial.

47. The system of claim 40, wherein the processing unit being operative to fit the mathematical function to the heat signature profile comprises the processing unit being operative to fit the mathematical function comprising a second order mathematical function.

48. The system of claim 40, wherein the processing unit being operative to create the heat signature profile for the casting comprises the processing unit being operative to create the heat signature profile comprising a natural temperature profile for the casting.

49. A system for providing porosity detection, the system comprising:

a memory storage; and a processing unit coupled to the memory storage, wherein the processing unit is operative to:

create a heat signature profile for a casting;

fit a mathematical function to the heat signature profile, wherein the processing unit being operative to fit the mathematical function to the heat signature profile comprises the processing unit being operative to fit the mathematical function comprising a polynomial;

compare the heat signature profile to the fitted mathematical function: and indicate that a void exists in the casting when, in response to the comparison, a peak value of the heat signature profile is less than a peak value of the mathematical function.

50. The system of claim 49, wherein the casting comprises one of the following: a copper casting and an aluminum casting.

51. The system of claim 49, wherein the processing unit being operative to create the heat signature profile for the casting comprises the processing unit being operative to create the heat signature profile for the casting from a first edge of the casting to a second edge of the casting.

52. The system of claim 49, further comprising the processing unit being operative to receive, from an infrared device, data corresponding to a heat signature for the casting.

53. The system of claim 49, further comprising the processing unit being operative to, in response to the indication that the void exists in the casting, slow down a casting process associated with the casting.

54. The system of claim 49, further comprising the processing unit being operative to indicate that a void does not exist in the casting when, in response to the comparison, a peak value of the heat signature profile is one of the following: greater than a peak value of the mathematical function and equal to a peak value of the mathematical function.

55. The system of claim 54, further comprising the processing unit being operative to, in response to the indication that the void does not exist in the casting, speed up a casting process associated with the casting.

56. The system of claim 49, wherein the processing unit being operative to create the heat signature profile for the casting comprises the processing unit being operative to create the heat signature profile comprising a natural temperature profile for the casting.

57. A system for providing porosity detection, the system comprising:

a memory storage; and a processing unit coupled to the memory storage, wherein the processing unit is operative to:

create a heat signature profile for a casting;

fit a mathematical function to the heat signature profile, wherein the processing unit being operative to fit the mathematical function to the heat signature profile comprises the processing unit being operative to fit the mathematical function comprising a second order polynomial;

compare the heat signature profile to the fitted mathematical function; and indicate that a void does not exist in the casting when, in response to the comparison, a peak value of the heat signature profile is one of the following: greater than a peak value of the mathematical function and equal to a peak value of the mathematical function.

58. The system of claim 57, wherein the casting comprises one of the following: a copper casting and an aluminum casting.

59. The system of claim 57, wherein the processing unit being operative to create the heat signature profile for the casting comprises the processing unit being operative to create the heat signature profile for the casting from a first edge of the casting to a second edge of the casting.

60. The system of claim 57, further comprising the processing unit being operative to receive, from an infrared device, data corresponding to a heat signature for the casting.

61. The system of claim 57, further comprising the processing unit being operative to indicate that a void exists in the casting when, in response to the comparison, a peak value of the heat signature profile is less than a peak value of the mathematical function.

62. The system of claim 61, further comprising the processing unit being operative to, in response to the indication that the void exists in the casting, slow down a casting process associated with the casting.

63. The system of claim 57, further comprising the processing unit being operative to, in response to the indication that the void does not exist in the casting, speed up a casting process associated with the casting.

64. The system of claim 57, wherein the processing unit being operative to create the heat signature profile for the casting comprises the processing unit being operative to create the heat signature profile comprising a natural temperature profile for the casting.

* * * * *

UNITED STATES PATENT AND TRADEMARK OFFICE

CERTIFICATE OF CORRECTION

PATENT NO. : 8,276,645 B2
APPLICATION NO. : 12/405288
DATED : October 2, 2012
INVENTOR(S) : Victor F. Rundquist et al.

It is certified that error appears in the above-identified patent and that said Letters Patent is hereby corrected as shown below:

IN THE CLAIMS:

Column 14, line 8, claim 34, “32” should read --33--.

Signed and Sealed this
Second Day of June, 2015

Michelle K. Lee

Michelle K. Lee
*Director of the United States Patent and Trademark Office*